US005374807A

United States Patent [19]

Yahav et al.

[11] Patent Number: 5,374,807

[45] Date of Patent: * Dec. 20, 1994

[54] DOMESTIC COOKING APPARATUS

[76] Inventors: Shimon Yahav, 90 Tchernokovsky Street, Rehovot; Yair Daar, Moshav Galia, both of Israel

[ * ] Notice: The portion of the term of this patent subsequent to Jun. 22, 2010 has been disclaimed.

[21] Appl. No.: 963,560

[22] Filed: Oct. 20, 1992

Related U.S. Application Data

[63] Continuation of Ser. No. 652,508, Feb. 8, 1991, Pat. No. 5,221,829.

[30] Foreign Application Priority Data

Oct. 15, 1990 [IL] Israel ..... 95988
Oct. 31, 1991 [IL] Israel ..... 97117

[51] Int. Cl.[5] ..... H05B 3/74

[52] U.S. Cl. ..... 219/464; 219/457; 219/543

[58] Field of Search ..... 219/464, 465, 466–468, 219/457, 458, 544, 545, 548, 492, 448, 543; 338/308–309; 392/435, 438

[56] References Cited

U.S. PATENT DOCUMENTS

| | | | |
|---|---|---|---|
| 2,600,486 | 2/1952 | Cox . | |
| 3,231,718 | 1/1966 | Vasile | 219/464 |
| 3,505,498 | 4/1970 | Shevlin | 219/385 |
| 3,805,023 | 4/1974 | Wainer | 219/543 |
| 3,813,520 | 5/1974 | Brouneus . | |
| 3,842,241 | 10/1974 | Isaacson . | |
| 3,869,596 | 3/1975 | Howie | 219/543 |
| 3,885,128 | 5/1975 | Dills | 219/457 |
| 3,919,763 | 11/1975 | Utam | 29/460 |
| 3,936,660 | 2/1976 | Blackwood | 219/544 |
| 3,974,360 | 8/1976 | Panzarino | 219/543 |
| 4,032,750 | 6/1977 | Hurko . | |
| 4,063,068 | 12/1977 | Johnson | 219/441 |
| 4,073,970 | 2/1978 | Allen | 427/96 |
| 4,150,280 | 4/1979 | Hurko | 219/464 |
| 4,161,648 | 7/1980 | Goessler | 219/464 |
| 4,286,377 | 9/1981 | Hurko et al. . | |
| 4,347,432 | 8/1982 | Goessler | 219/449 |
| 4,507,546 | 3/1985 | Fortune | 219/497 |
| 4,524,264 | 6/1985 | Takeuchi | 219/492 |
| 4,816,647 | 3/1989 | Payne | 219/464 |
| 4,843,218 | 6/1989 | Hussiein | 219/457 |
| 4,973,826 | 11/1990 | Baudry et al. | 219/464 |
| 5,221,829 | 6/1993 | Yahav et al. | 219/464 |

FOREIGN PATENT DOCUMENTS

| | | | |
|---|---|---|---|
| 2219890 | 10/1973 | Germany | 219/464 |
| 2264946 | 9/1975 | Germany | 219/464 |
| 8300308 | 8/1984 | Netherlands . | |
| 140866 | 12/1966 | New Zealand . | |
| 177289 | 9/1976 | New Zealand . | |
| 178292 | 8/1977 | New Zealand . | |
| 218491 | 1/1990 | New Zealand . | |
| 223613 | 3/1990 | New Zealand . | |
| 743322 | 1/1956 | United Kingdom . | |
| 846310 | 8/1960 | United Kingdom . | |
| 1154821 | 6/1969 | United Kingdom . | |
| 8505528 | 11/1985 | WIPO . | |

OTHER PUBLICATIONS

Sigg catalogue–Sigg Ltd. Metalware Manufactures, CH–8500 Frauenfeld, Switzerland.

*Primary Examiner*—Bruce A. Reynolds
*Assistant Examiner*—John A. Jeffery
*Attorney, Agent, or Firm*—Ladas & Parry

[57] ABSTRACT

A domestic cooking appliance having a housing whose top surface is formed with a flat cooking surface made from a layer of ceramic material of high thermal shock resistance capable of being heated to a temperature of at least 200° C. A foil heating element supplies heat to the lower surface of the layer of ceramic material. A metal layer is mounted on the opposite surface of the foil heating element via an electrical insulator and a thermal insulator layer is disposed on the back surface of the metal layer.

18 Claims, 5 Drawing Sheets

DOMESTIC COOKING APPARATUS

This is a continuation of copending application Ser. No.07/652,508 filed on Feb. 8, 1991, now U.S. Pat. No. 5,221,829.

FIELD OF THE INVENTION

The present invention relates to domestic cooking apparatus generally.

BACKGROUND OF THE INVENTION

Various types of cooking appliances are known in the patent literature. U.S. Pat. No. 4,073,970 describes a method of making an electric heating unit employing a sinuous strip of a gold/platinum alloy. U.S. Pat. No. 4,347,432 describes a glass ceramic cooking appliance employing a heating coil which heats the glass ceramic by radiation. U.S. Pat. No. 4,161,648 describes an electrical radiation heater-for a glass ceramic plate which is spaced therefrom and heats the plate by radiation. U.S. Pat. No. 3,869,596 describes a cookware heater employing a printed circuit foil type heating circuit which is bonded to a ceramic or metallic surface.

There are known electric household appliances which provide warming of cooked food products and employ a foil heating element. An example is shown in the Sigg Catalog of 1987–1988 of Sigg Ltd. of Frauenfeld/Switzerland.

SUMMARY OF THE INVENTION

The present invention seeks to provide improved domestic cooking apparatus.

There is thus provided in accordance with a preferred embodiment of the present invention domestic cooking apparatus including a layer of material having high temperature thermal shock resistance and defining a first surface which is a planar cooking surface and a second surface, and a foil heating element disposed in heat transfer engagement with the second surface, wherein the foil heating element is operative to heat at least a portion of the material having high temperature thermal shock resistance to a temperature exceeding 200 degrees centigrade and preferably to a temperature exceeding 270 degrees centigrade.

Preferably the material having high temperature thermal shock resistance comprises ceramic glass or metal.

There may be provided an electrical insulative layer disposed in intimate touching relationship between the foil heating element and the second surface. Alternatively, the foil heating element may be disposed in intimate touching relationship with the second surface.

Preferably the foil heating element provides heating of a density of at least 20 Watt per square inch of the area of the second surface generally overlying the overall region of the foil element.

Preferably the foil heating element provides heating of a density of at least 20 Watt per square inch of the area of the second surface subtended by the shortest closed planar convex curve circumscribing the projection thereon of the heating element of a cooking location excluding the electrical leads thereto.

Additionally there may be provided at least one heat reflecting layer disposed under the foil heating element.

There is additionally provided in accordance with a preferred embodiment of the present invention an oven including a housing defining a plurality of interior oven wall surfaces and oven heating apparatus disposed along at least one of the plurality of interior oven wall surfaces and including:

- a layer of material having high temperature thermal shock resistance and defining a first and a second surface; and
- a foil heating element disposed in heat transfer engagement with the second surface of the material layer having high temperature thermal shock resistance, wherein the foil heating element is operative to heat at least a portion of the material having high temperature thermal shock resistance to a temperature exceeding 200 degrees centigrade.

The oven may also include an insulative layer disposed adjacent the foil heating element in intimate touching relationship therewith.

Additionally in accordance with a preferred embodiment of the present invention, there is provided means for sensing the temperature of the planar cooking surface by sensing changes in the electrical resistance of the foil heating element.

Additionally in accordance with a preferred embodiment of the present invention there is provided apparatus for governing the electrical power supplied to the foil heating element in accordance with the sensed temperature thereof.

In accordance with a preferred embodiment of the present invention a layer of metal may be provided in thermal communication with the foil heating element for prevention of localized overheating of the planar cooking surface.

Preferably the metal is a metal having high thermal conductivity, such as aluminum. According to one preferred embodiment of the invention, the layer of metal is located intermediate the foil heating element and the planar cooking surface and thus receives heat from the foil heating element and in turn heats the planar cooking surface.

According to an alternative embodiment of the invention, the layer of metal is located on a side of the foil heating element opposite from that of the planar cooking surface and serves to absorb heat from the foil heating element particularly from locations at which relatively less heat is absorbed by the planar cooking surface.

There may also be provided an insulative layer disposed underneath the foil heating element in intimate touching relationship therewith and spring apparatus for urging the insulative layer, the foil heating element and the material having high temperature thermal shock resistance and any intermediate layers associated therewith together in intimate engagement.

BRIEF DESCRIPTION OF THE DRAWINGS

The present invention will be understood and appreciated more fully from the following detailed description, taken in conjunction with the drawings in which.

DETAILED DESCRIPTION OF THE INVENTION

Figure 1:
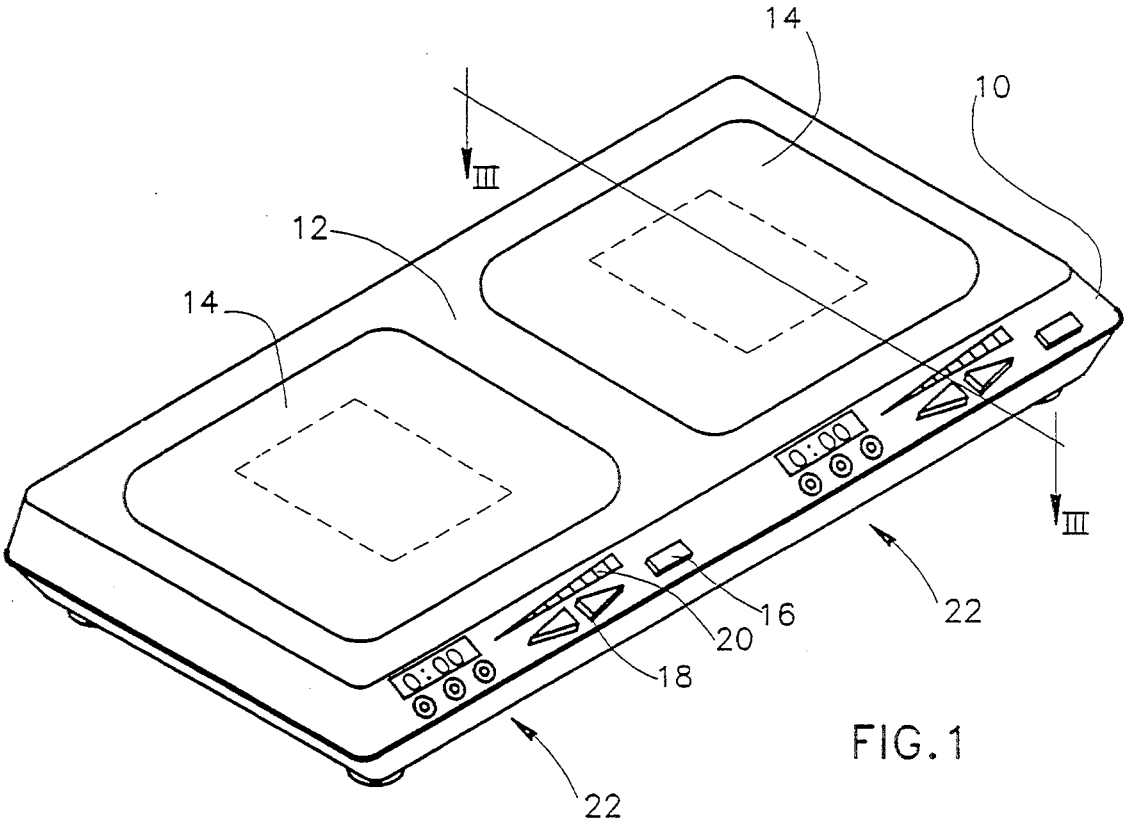
FIG. 1 is a pictorial illustration of cooking apparatus constructed and operative in accordance with a preferred embodiment of the present invention.

Reference is now made to FIG. 1, which illustrates domestic cooking apparatus constructed and operative in accordance with a preferred embodiment of the invention. The domestic cooking apparatus comprises a housing 10, the top surface of which is formed of a cooking surface layer 12 of material having high thermal shock resistance, enabling it to be heated to a temperature of at least 200 degrees centigrade and preferably to a temperature in excess of 270 degrees centigrade and up to or exceeding 600 degrees centigrade.

According to one embodiment of the invention, the cooking surface layer 12 is integrally formed with the top surface of the housing and defines on a top surface thereof a plurality of cooking locations 14. Alternatively, only the cooking surface layer at the cooking locations 14 may be formed of a material having high thermal shock resistance and the remaining portion of the top surface may be formed of a different material.

Presently preferred materials for use as the cooking surface layer 12 at least at the cooking locations 14 include ceramic glass, stainless steel or other suitable metals.

Mounted on housing 10 are operating controls for the cooking locations 14, typically including an ON/OFF switch 16, power controls 18, and a display 20, indicating the operating status of each cooking location. A timer and clock display assembly 22 may also be provided.

Figure 3A:
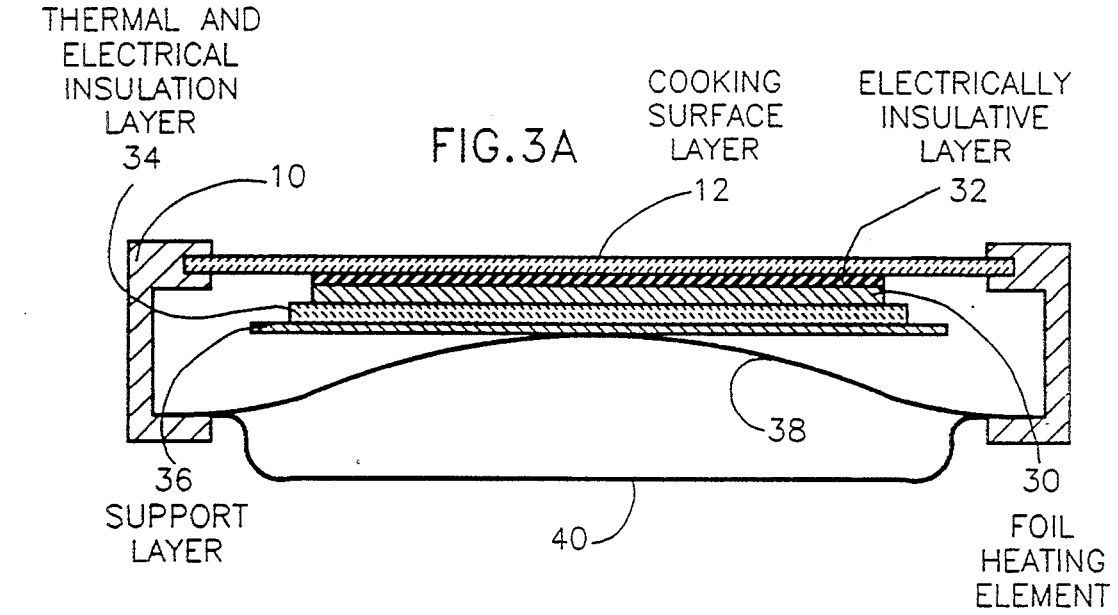
FIGS. 3A, 3B and 3C are each a partial sectional illustration taken along lines III—III of FIG. 1, for a different preferred embodiment of the invention.

Referring now additionally to FIG. 3A, it is seen that in accordance with a preferred embodiment of the invention, a foil heating element 30 is supported in intimate conductive heat transfer engagement underlying the thermal shock resistant cooking surface layer 12. If desired, one or more electrically insulative, heat conductive insulative layers 32 may be interposed between foil heating element 30 and layer 12. Where layer 12 is formed of metal, such a layer 32 is required. Layer 32 may be formed of mica or of any other suitable material. Preferably the thickness of foil heating element 30 is less than 0.3 mm.

Disposed underlying heating element 30 is at least one layer 34 of thermal and electrical insulation material, such as glass or mica. Underlying layer 34 is typically provided a relatively rigid layer 36 of a material, preferably a metal.

Urging heating element 30 into intimate heat transfer engagement with layer 12 is a spring, such as a wide leaf spring 38, which is preferably prestressed so as to be seated on housing 10 and to force rigid layer 36 against layers 30, 32 and 34 and forcing those layers against-,each other and against layer 12. This arrangement provides intimate heat transfer engagement between the heating element 30 and the layer 12 while making provision for thermal displacements of the various layers.

Disposed below spring 38 is preferably provided a metal heat reflector 40, typically formed of stainless steel or aluminum.

Figure 3B:
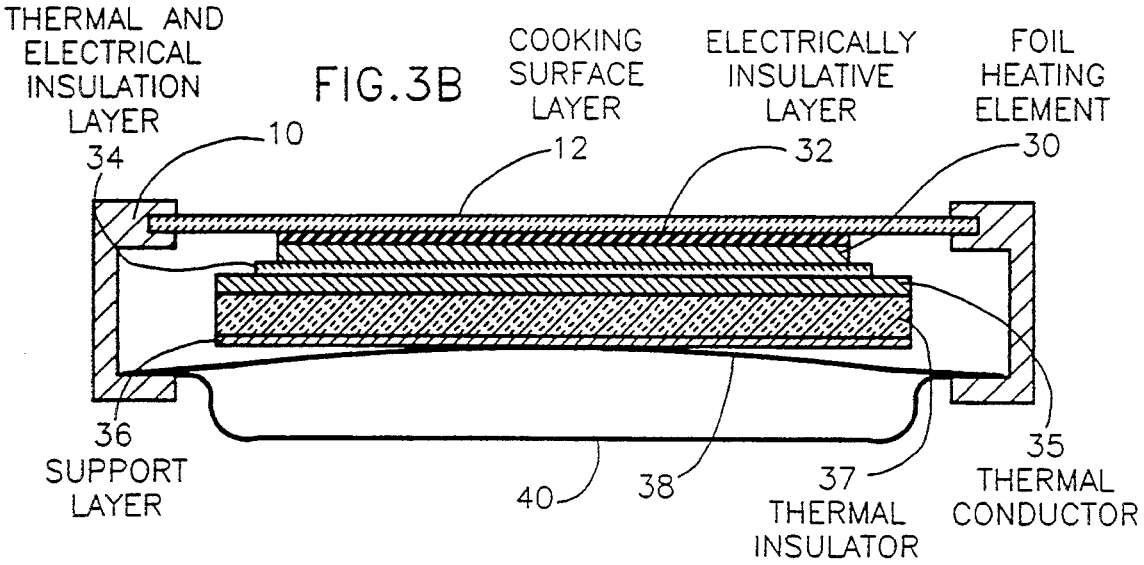

Reference is now made to FIG. 3B, which illustrates an alternative embodiment of the invention similar to that of FIG. 3A and wherein the layer 12 is formed of ceramic glass. There is also provided an additional layer 35 of a metal having high thermal conductivity, such as aluminum, and a thermal insulator such as a ceramic blanket 37 underlying layer 35. These two additional layers are disposed between layers 34 and 36.

Figure 3C:
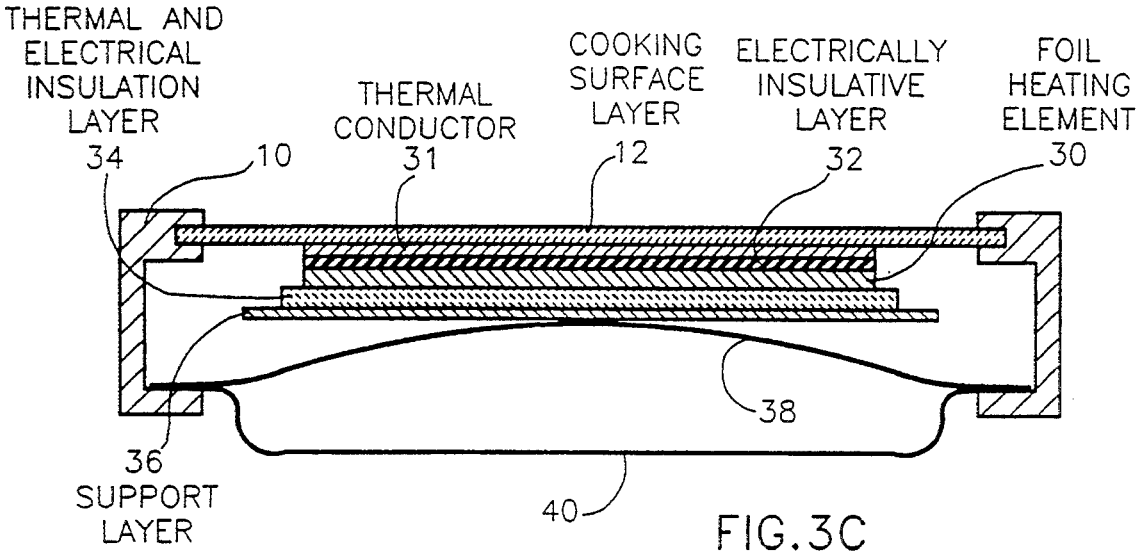

Reference is now made to FIG. 3C which illustrates a further alternative embodiment of the invention similar to that of FIG. 3A wherein the layer 12 is formed of ceramic glass. A layer 31 formed of a metal having high thermal conductivity is provided underlying layer 12. A layer 32, of the composition described above, must be provided in this case.

Figure 2:
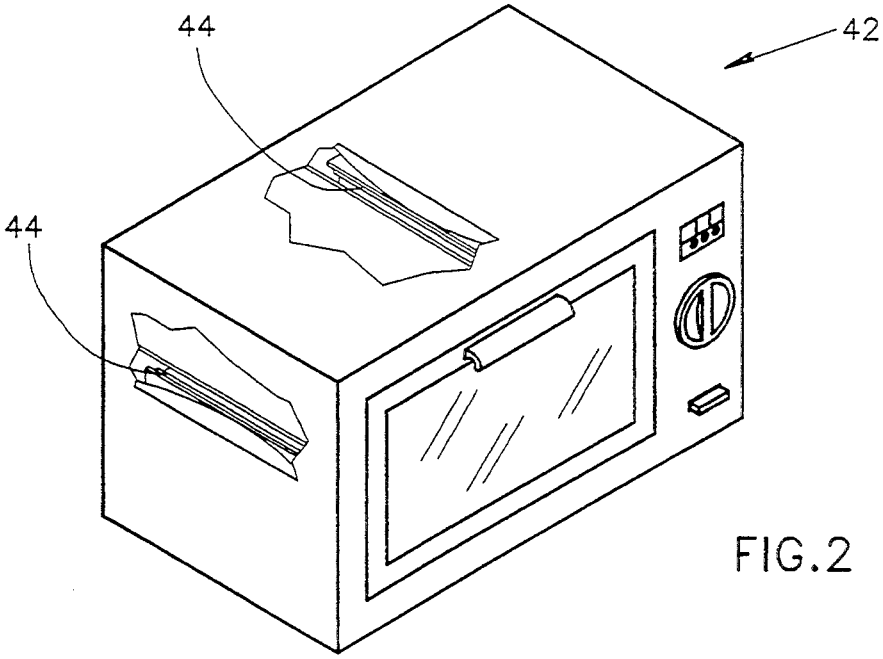
FIG. 2 is a pictorial illustration of cooking apparatus constructed and operative in accordance with another preferred embodiment of the present invention.

Reference is now made to FIG. 2, which illustrates an oven 42 which is constructed and operative in accordance with the present invention. The oven is provided with a heating assembly 44 of the type illustrated in any of FIGS. 3A–3C, which heating assembly may be mounted upside down from the top of the oven or sideways along the oven walls.

Figure 4A:
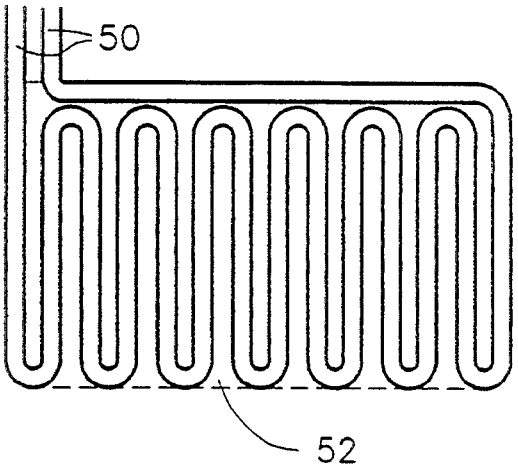
FIGS. 4A, 4B and 4C are illustrations of three different embodiments of foil heating element useful in the present invention.
Figure 4B:
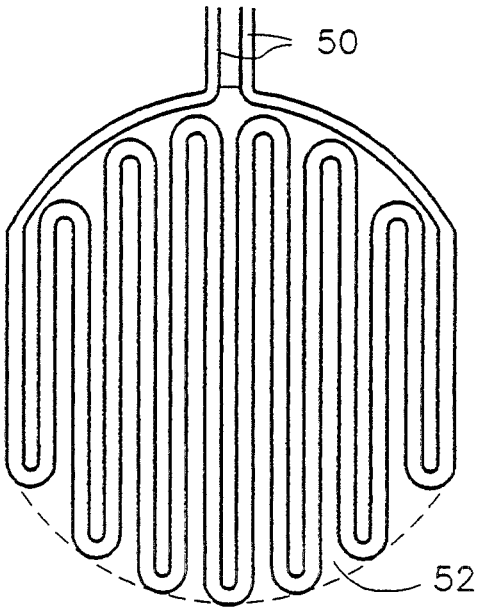
Figure 4C:
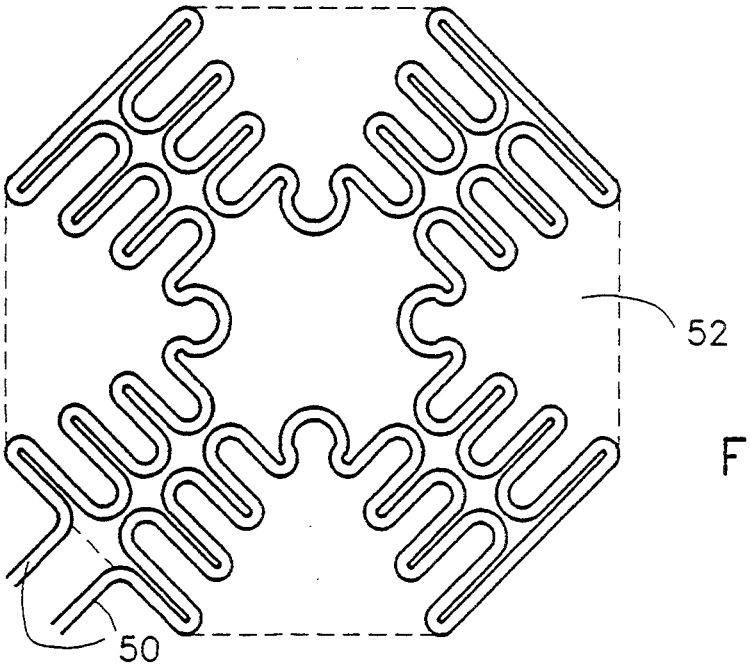

Reference is now made to FIGS. 4A, 4B and 4C, which illustrate three typical configurations of a foil heating element. In the embodiment of FIG. 4A, the overall configuration is rectangular, while in the embodiment of FIG. 4B, the overall configuration is nearly circular and in the embodiment of FIG. 4C, the overall configuration is polygonal.

It is a particular feature of the present invention that an extremely high density of heat output is provided per unit area of the foil heating element. Preferably the foil heating element 30 provides a heat output density of at least 20 Watt per square inch of area of the cooking surface layer 12 generally overlying the overall region of the foil heating element.

More specifically the foil heating element preferably provides heating of a density of at least 20 Watt per square inch of the area 52 of the cooking surface subtended by the shortest closed planar convex curve circumscribing the projection thereon of the heating element of a cooking location excluding the electrical leads 50 thereto.

Preferable heat output densities are above 30 Watt per square inch and may exceed 70 Watt per square inch.

Preferably the foil heating element provides a heat output exceeding 0.8 KW. It is also preferable, from a cooking heat efficiency standpoint, that the foil heating element forming part of a cooking surface be fully covered by the bottom surface of a cooking utensil during operation.

Figure 5A:
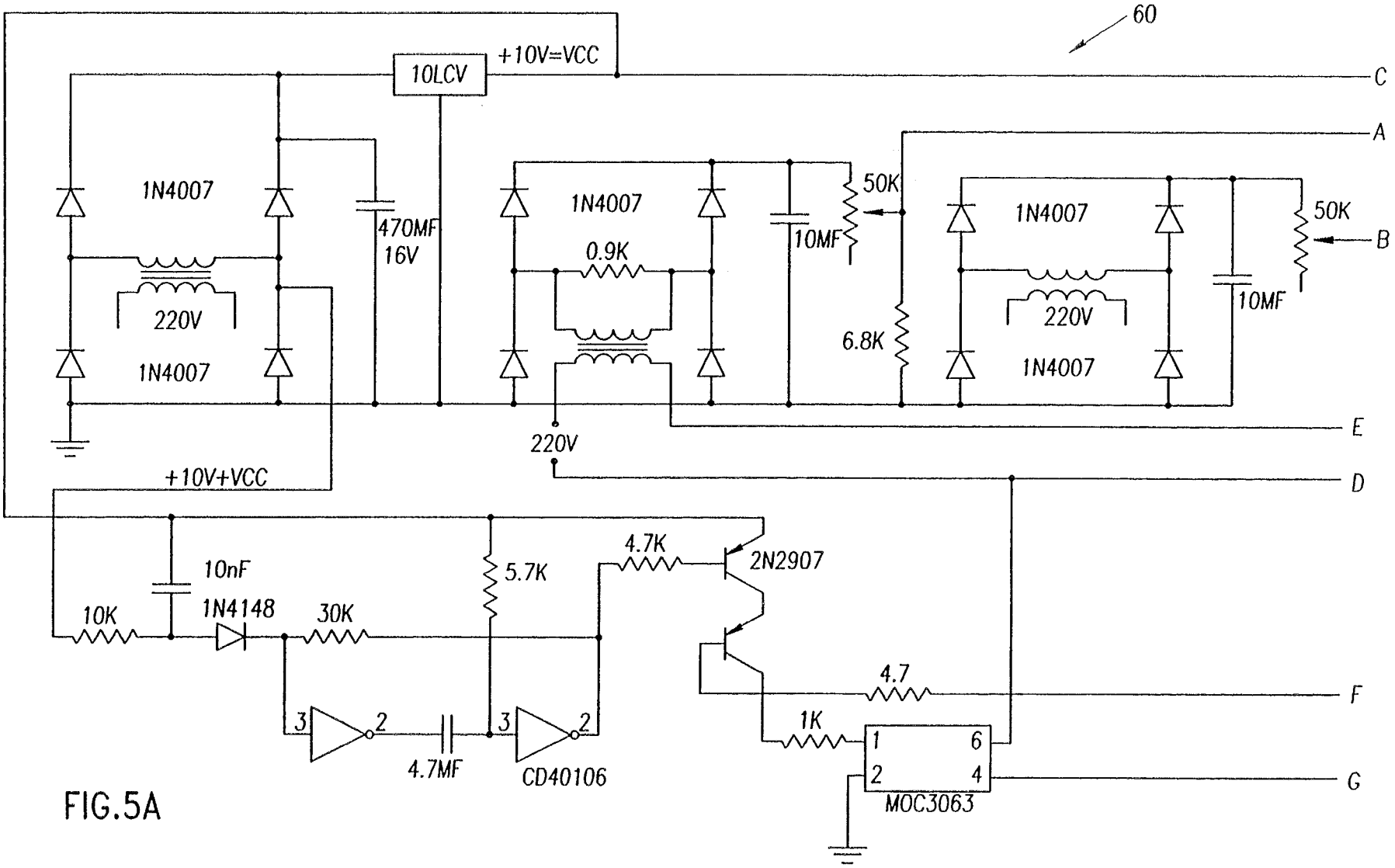
FIGS. 5A and 5B collectively form is an electrical schematic illustration of temperature sensing and controlling circuitry useful in the present invention.
Figure 5B:
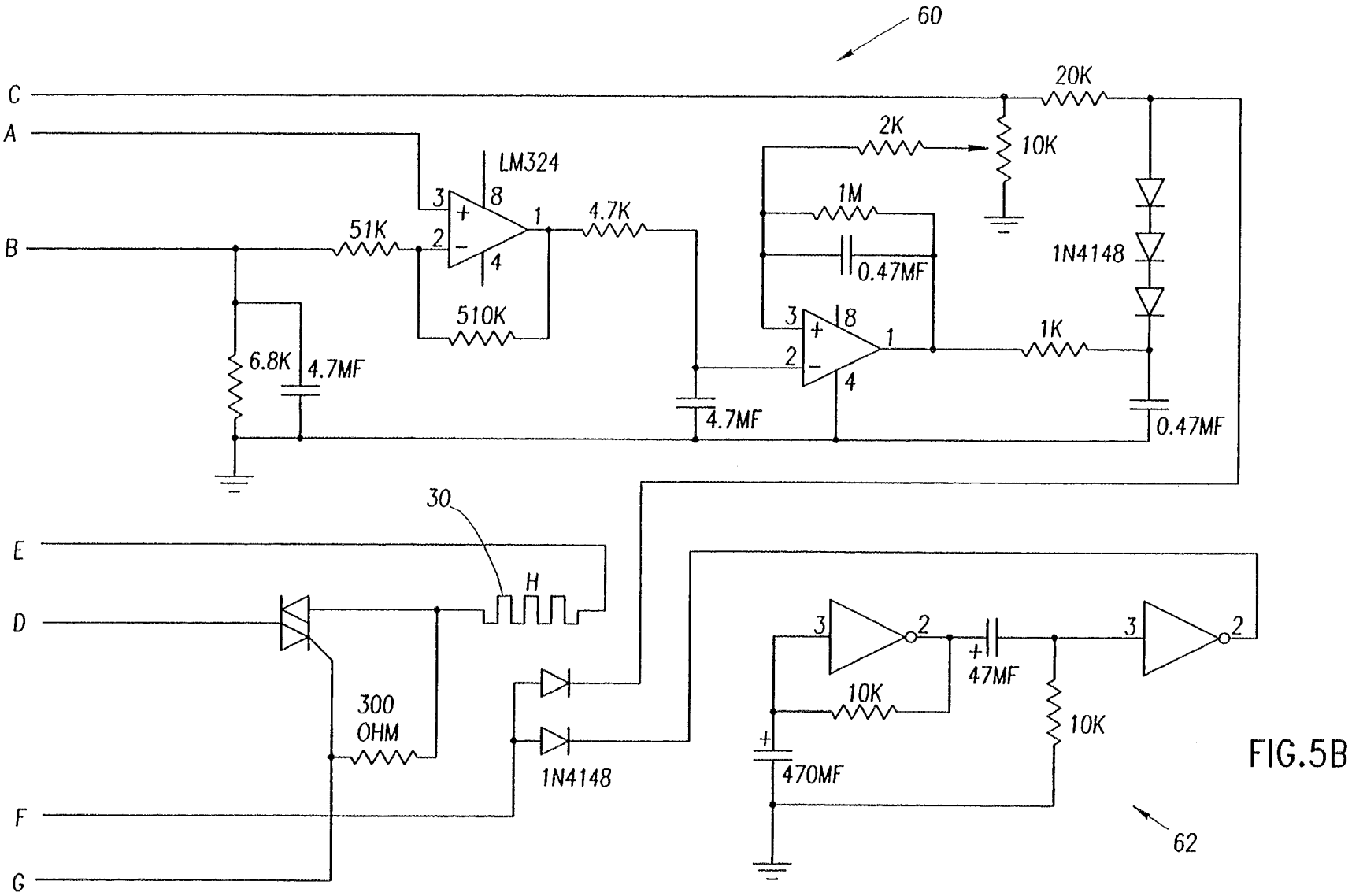

Reference is now made to FIGS. 5A and 5B collectively represent a schematic illustration of circuitry for sensing and controlling the temperature of the foil heating element 30. Portion 60 of the circuitry serves to sense the resistance of the heating element 30 by sampling the current passing therethrough, which is proportional to the resistance thereof, and related to the temperature of the cooking surface layer 12. Portion 60 is operative to compare the temperature of the foil heating element with a preset desired temperature while portion 62 of the circuitry operates to vary the electrical power supplied to the heating element 30 to maintain the desired temperature. By governing the temperature of the heating element 30, undesired overheating of the cooking surface layer 12 is prevented.

It will be appreciated by persons skilled in the art that the present invention is not limited by what has been particularly shown and described hereinabove. Rather the scope of the present invention is defined only by the claims which follow:

We claim:

1. Domestic cooking apparatus comprising:

a layer of ceramic material having high temperature thermal shock resistance and defining a first surface which is a planar cooking surface and a second surface;

a foil heating element disposed in heat transfer relation with said second surface of said layer of material having high temperature thermal shock resistance, wherein said foil heating element is operative to heat at least a portion of said ceramic material having high temperature thermal shock resistance to a temperature exceeding 200 degrees centigrade;

a layer of metal located adjacent a side of the foil heating element opposite from that facing the planar cooking surface;

a layer of an electrical insulator disposed between said layer of metal and said foil heating element; and a layer of a thermal insulator disposed adjacent a side of said layer of metal, opposite from that facing the foil-heating element.

2. Domestic cooking apparatus according to claim 1 and wherein said foil heating element is operative to heat at least a portion of said material having high temperature thermal shock resistance to a temperature exceeding 270 degrees centrigrade.

3. Apparatus according to claim 2 and also comprising means for sensing the temperature of said foil heating element by measuring the electrical resistance thereof and means for governing the electrical power supplied to said foil heating element in accordance with the sensed temperature thereof.

4. Domestic cooking apparatus according to claim 3 and wherein said foil heating element provides heating of a density of at least 20 Watt per square inch of the area of said second surface subtended by the shortest closed planar convex curve circumscribing the projection thereon of the foil heating element of a cooking location excluding the electrical leads thereto.

5. Domestic cooking apparatus according to claim 4 and also comprising a second layer of an electrical insulator disposed between said foil heating element and said layer of a ceramic material.

6. Domestic cooking apparatus according to claim 3 and also comprising a second layer of an electrical insulator disposed between said foil heating element and said layer of a ceramic material.

7. Domestic cooking apparatus according to claim 2 and wherein said foil heating element is operative to heat at least a portion of said material having high temperature thermal shock resistance to a temperature exceeding 350 degrees centigrade.

8. Domestic cooking apparatus according to claim 7 and wherein said foil heating element provides heating of a density of at least 20 Watt per square inch of the area of said second surface generally overlying the overall region of said foil heating element.

9. Domestic cooking apparatus according to claim 8 and also comprising at least one heat reflecting layer disposed under said layer of a thermal insulator.

10. Domestic cooking apparatus according to claim 9 and also comprising a second layer of an electrical insulator disposed between said foil heating element and said layer of a ceramic material.

11. Domestic cooking apparatus according to claim 7 and also comprising a second layer of an electrical insulator disposed between said foil heating element and said layer of a ceramic material.

12. Domestic cooking apparatus according to claim 8 and also comprising a second layer of an electrical insulator disposed between said foil heating element and said layer of a ceramic material.

13. Domestic cooking apparatus according to claim 2 and also comprising a second layer of an electrical insulator disposed between said foil heating element and said layer of a ceramic material.

14. Domestic cooking apparatus according to claim 1 and also comprising means for urging said layer of a thermal insulator, said foil heating element and said material having high temperature thermal shock resistance as well as any intervening layers associated therewith together in intimate engagement.

15. Domestic cooking apparatus according to claim 14 and also comprising a second layer of an electrical insulator disposed between said foil heating element and said layer of a ceramic material.

16. Domestic cooking apparatus according to claim 1 and also comprising a second layer of an electrical insulator disposed between said foil heating element and said layer of a ceramic material.

17. Domestic cooking apparatus according to claim 16 and also comprising at least one heat reflecting layer disposed under said layer of a thermal insulator.

18. Domestic cooking apparatus according to claim 1 and also comprising at least one heat reflecting layer disposed under said layer of a thermal insulator.

* * * * *